US007849565B2

(12) United States Patent
Swain et al.

(10) Patent No.: US 7,849,565 B2
(45) Date of Patent: Dec. 14, 2010

(54) SLIDER FOR WATER-RESISTANT ZIPPERS

(75) Inventors: Henry Swain, Whitehouse Station, NJ (US); Lynnette Dehnke, Arlington Heights, IL (US); Lawrence Share, Skokie, IL (US); Valoris L. Forsyth, Lewisville, TX (US)

(73) Assignee: Illinois Tool Works Inc., Glenview, IL (US)

( * ) Notice: Subject to any disclaimer, the term of this patent is extended or adjusted under 35 U.S.C. 154(b) by 744 days.

(21) Appl. No.: 11/820,544

(22) Filed: Jun. 20, 2007

(65) Prior Publication Data

US 2008/0313863 A1 Dec. 25, 2008

(51) Int. Cl.
*A44B 19/26* (2006.01)
*B65D 33/16* (2006.01)

(52) U.S. Cl. ..... 24/30.5 R; 24/415; 24/428; 24/585.12; 383/64

(58) Field of Classification Search ..... 24/415, 24/427, 428, 30.5 R, 585.1, 585.11, 585.12; 383/64

See application file for complete search history.

(56) References Cited

U.S. PATENT DOCUMENTS 3,220,076 A 11/1965 Ausnit et al.
3,259,951 A * 7/1966 Zimmerman ..... 24/427
5,020,194 A * 6/1991 Herrington et al. ..... 24/400
5,638,586 A 6/1997 Malin et al.
5,809,621 A * 9/1998 McCree et al. ..... 24/399
5,871,281 A * 2/1999 Stolmeier et al. ..... 24/417
6,739,755 B2 * 5/2004 Schreiter ..... 24/400
6,761,481 B1 7/2004 Bois
6,826,808 B2 * 12/2004 Kutschka ..... 24/585.12
2004/0086206 A1 5/2004 Tomic

FOREIGN PATENT DOCUMENTS

EP 0 479 661 A 4/1992
JP 2005/152316 A 6/2005
WO WO 2008/060752 A 5/2008

OTHER PUBLICATIONS

U.S. Appl. No. 11/634,447.

* cited by examiner

*Primary Examiner*—Robert J Sandy
(74) *Attorney, Agent, or Firm*—Day Pitney LLP

(57) ABSTRACT

The water-resistant or waterproof zipper includes first and second profiles which are interlocked or separated by the movement of a slider. The first sidewall of the slider is generally planar while the second sidewall is generally curved so that the sidewalls are relatively closer together at the closing end and generally further apart at the opening end. A triangular island and separating plow are formed at the opening end to separate the first and second profiles. The slider includes various channels which engage corresponding rails in the profiles in order to properly position the profiles. The slider further includes various protrusions and a flange to properly position the profiles.

6 Claims, 2 Drawing Sheets

SLIDER FOR WATER-RESISTANT ZIPPERS

BACKGROUND OF THE INVENTION

1. Field of the Invention

The present invention relates to a slider for a watertight reclosable zipper. In particular, the design of this slider allows both easy opening and closing of the zipper while maintaining the watertight or water-resistant characteristics.

2. Description of the Prior Art

Examples of watertight reclosable zippers are shown in FIGS. 1A, 1B, 1C, 1D and 1E. These zippers, or similar zippers, may be used with sliders such as are disclosed in U.S. pat. application Ser. No. 11/634,447 entitled "One-Sided Rail Slider", filed on Dec. 6, 2006. While these zippers and sliders are well-developed and have proven satisfactory for their intended purposes, further improvements are sought in providing increased ease in the opening and closing of the zipper while maintaining the watertight or water-resistant configuration and further providing a place for the slider to park when not in use.

OBJECTS AND SUMMARY OF THE INVENTION

It is therefore an object of the present invention to provide a watertight or water-resistant slider zipper with increased ease in opening and closing, as well as finding a place to park the slider when not in use, while maintaining the watertight or water-resistant configuration.

These and other objects are attained by providing a watertight or water-resistant zipper with a plastic or metal slider which straddles the zipper profiles in its vertical position thereby engaging both zipper profiles simultaneously. The slider includes a blade that protrudes between the two profiles in order to effect the opening of the zipper profiles. As the user pulls the slider along the top of the zipper, the blade separates the interlocked profiles. Likewise, when the slider is pulled in the opposite direction, the inner dimension of the slider squeezes the profiles into an interlocked configuration. The slider is shaped so as to be easy to grasp by the user. The slider is configured so that when the profile is closed, the watertight seal remains engaged. In the home or park position of the slider, the profile is cut to receive the blade of the slider. Moreover, a notch is formed to further improve the seal.

BRIEF DESCRIPTION OF THE DRAWINGS

Further objects and advantages of the invention will become apparent from the following description and from the accompanying drawings, wherein.

DETAILED DESCRIPTION OF THE PREFERRED EMBODIMENT

Figures 1A, 1B, 1C, 1D, 1E:
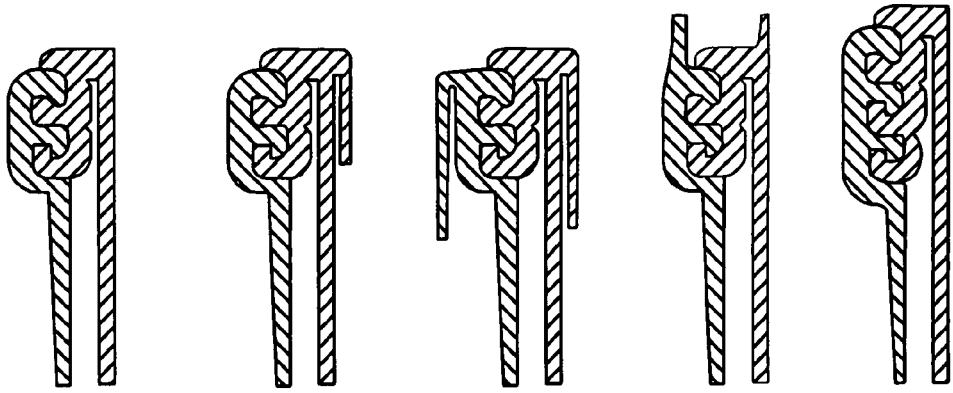
FIGS. 1A, 1B, 1C, 1D and 1E are cross-sectional views of various prior art waterproof or water-resistant zippers.
Figure 2:
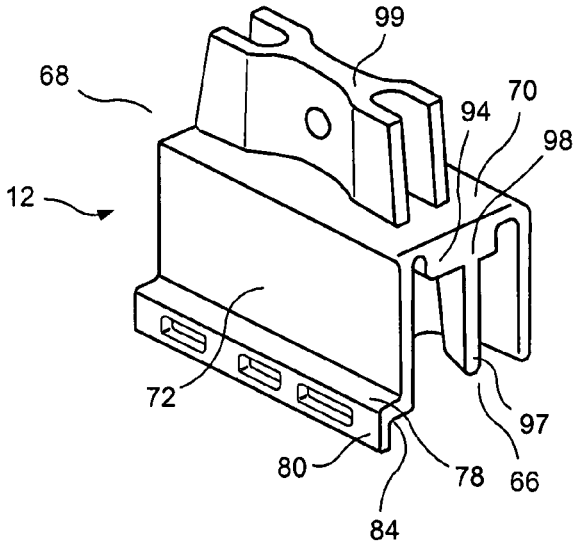
FIG. 2 is a top perspective view of the slider of the zipper assembly of the present invention.
Figure 3:
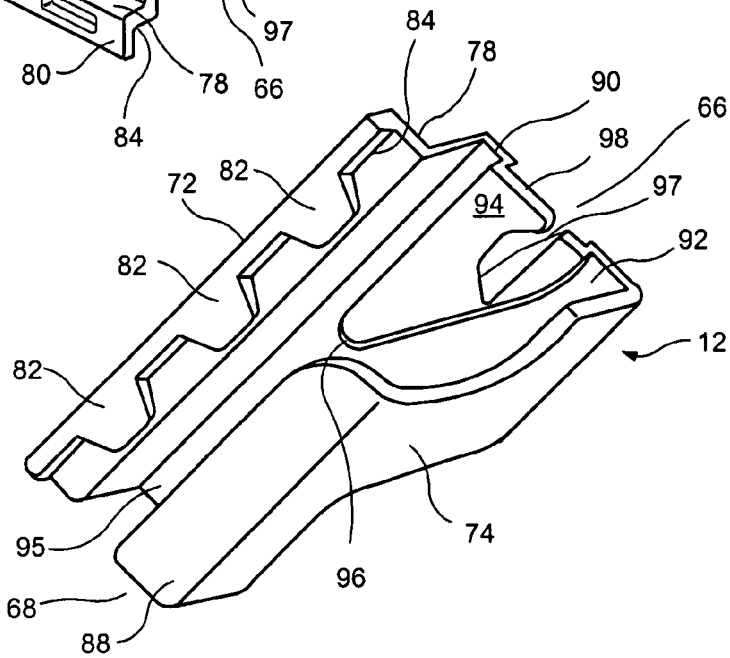
FIG. 3 is a bottom perspective view of the slider of the zipper assembly of the present invention.
Figure 4:
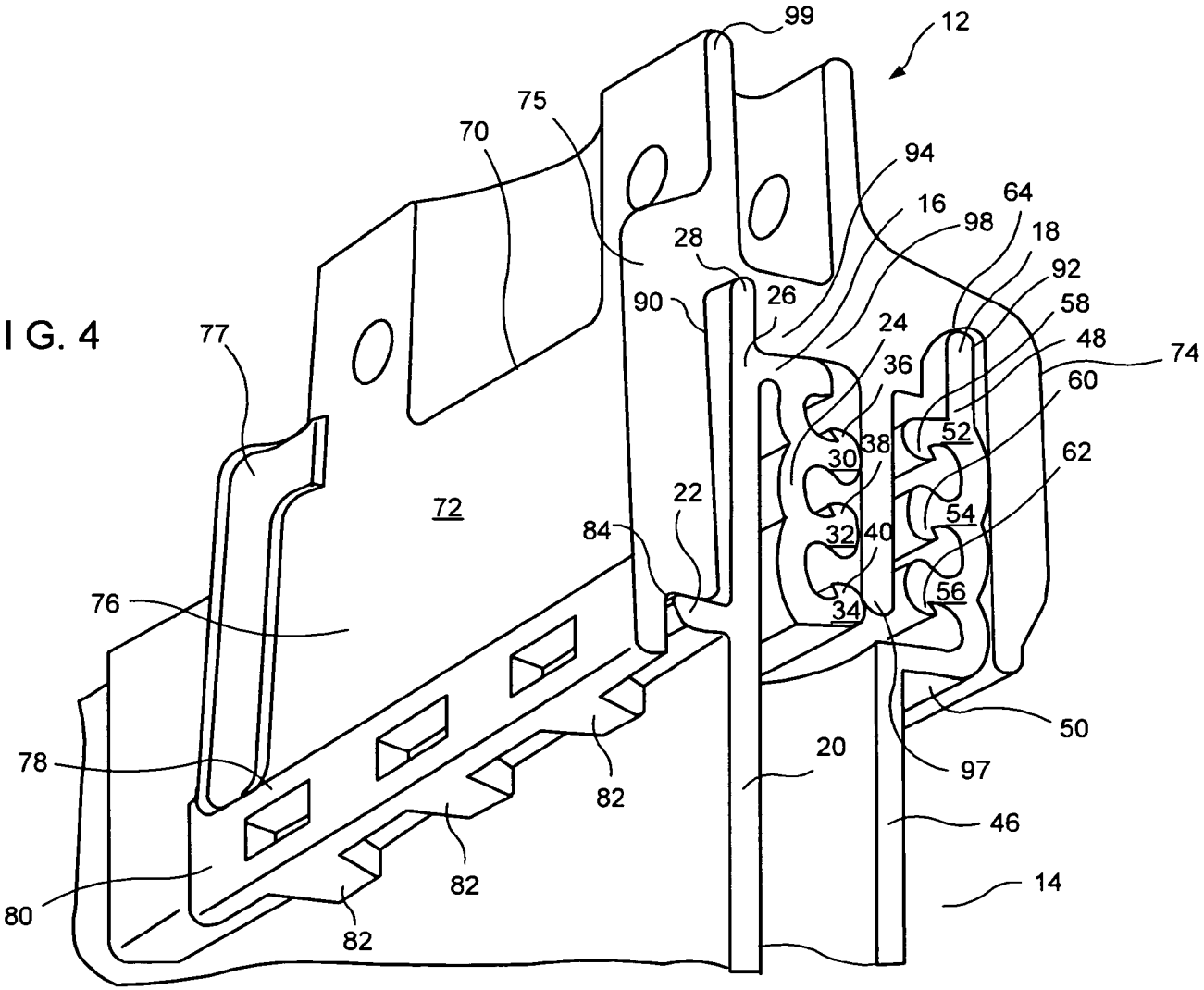
FIG. 4 is a perspective view of the zipper assembly of the present invention.

Referring now to the drawings in detail wherein like numerals indicate like elements throughout the several views, one sees that FIGS. 2 and 3 are perspective views of slider 12 while FIG. 4 is a perspective view of the slider 12 engaging zipper 14 so as to form zipper assembly 10.

Zipper 14 includes first profile 16 and second profile 18. First profile 16 includes first flange 20 which further includes rail 22. First flange 20 extends across the outward face of first interlocking element 24 and is hinged to the top of first interlocking element 24 at hinged point 26. Additionally, first upper rail 28 extends upwardly from hinged point 26. First interlocking element 24 includes inwardly extending teeth 30, 32, 34 terminating in respective detent heads 36, 38, 40.

Second profile 18 includes second flange 46 which is inwardly offset from second interlocking element 48 by horizontal inverted ledge 50. First and second flanges 20, 46, are used to attach the zipper 14 to the walls of a container (not shown). Second interlocking element 48 includes inwardly extending teeth 52, 54, 56 terminating in respective detent heads 58, 60, 62. Inwardly extending teeth 30, 32, 34 interlock with respective interlocking teeth 58, 60, 62 in the interlocked configuration. Further, the offset provided by horizontal inverted ledge 50 allows first and second flanges 20, 46 to be positioned immediately adjacent to each other when the first and second profiles 16, 18 are in the interlocked configuration. Second profile 18 further includes second upper rail 64 extending upwardly from the upper portion of second interlocking element 48.

Slider 12 includes opening end 66 wherein first and second profiles 16, 18 are separated and closing end 68 wherein first and second profiles 16, 18 are interlocked. Slider 12 includes top wall 70 from which first sidewall 72 and second sidewall 74 descend. Optionally, as shown in FIG. 4, front and rear support walls 75, 77 may be formed at the respective opening and closing ends 68, orthogonal to the sidewalls 72, 74, in order to stiffen the construction of the slider 12. First sidewall 72 includes planar portion 76 which joins ledge 78. Outer wall 80 descends from ledge 78 and terminates in inwardly extending protrusions 82 thereby forming horizontal or lateral channel 84 bounded on the lower portion by inwardly extending protrusions 82 and bounded on the upper portion by the underside of ledge 78 which is upwardly adjacent from protrusions 82. Horizontal channel 84 is engaged by lateral rail 22 of first profile 16.

Second sidewall 74 has a curved shape so that second sidewall 74 is positioned relatively closer to first sidewall 72 at closing end 68 and is positioned relatively further from first sidewall 72 at opening end 66. Lower inwardly extending flange 88 is formed on the lower end of second sidewall 74 proximate to the closing end 68 to engage and position horizontal inverted ledge 50 of second profile 16. Lower inwardly extending flange 88 typically is directly opposite from protrusions 82.

First and second vertical channels 90, 92 are formed in the underside of top wall 70 to be engaged by respective first and second upper rails 28, 64. At opening end 66 of slider 12, first and second vertical channels 90, 92 are separated by generally triangular island 94. First and second vertical channels 90, 92 form a single unified channel 95 (or form a closely spaced parallel relationship while maintaining separate channels) between rear tip 96 of triangular island 94 and closing end 68.

Separating plow 97 extends downwardly from forward end 98 of triangular island 94 proximate to opening end 66. Separating plow 97 serves to fully separate interlocking teeth 30, 32, 34 of first interlocking element 24 from interlocking teeth 52, 54, 56 of second interlocking element 48 and to maintain first and second profiles 16, 18 against the interior of respective first and second sidewalls 72, 74.

Grasping element 99 is formed on the upper surface of top wall 70 of slider 12. Grasping element 99 can any of many different shapes to allow a user to grasp the grasping element 99 and move slider in a closing direction (i.e., toward opening end 66) thereby interlocking the first and second profiles 14, 16 or in an opening direction (i.e., toward closing end 68) thereby separating the first and second profiles 14, 16 from each other.

The first and second profiles 16, 18 may include cut-out portions (not shown) to accommodate the separating plow 97 and allow first and second profiles 16, 18 to be interlocked when the slider 12 is in the fully closed and parked position.

Thus the several aforementioned objects and advantages are most effectively attained. Although preferred embodiments of the invention have been disclosed and described in detail herein, it should be understood that this invention is in no sense limited thereby and its scope is to be determined by that of the appended claims.

What is claimed is:

1. A slider for a zipper including:

a top wall;

a first sidewall extending from a first side of the top wall;

a second sidewall extending from a second side of the top wall;

an opening end wherein the first and second sidewalls are relatively further apart and a closing end wherein the first and second sidewall are relatively closer together;

the top wall including first and second upper channels separated by a triangular island at the opening end, wherein the first and second channels are relatively further apart at the opening end and relatively closer together at the closing end; wherein the triangular island includes one face adjacent to the opening end and one point directed toward the closing end;

a separator plow descending from the triangular island;

a lateral channel formed on the first sidewall;

wherein the first upper channel passes along a first side of the triangular island and the second upper channel passes along a second side of the triangular island; and wherein the first and second upper channels join in the area between the triangular island and the closing end.

2. The slider of claim 1 wherein the lateral channel is formed between an inverted ledge and inwardly extending protrusions on the first sidewall.

3. The slider of claim 2 wherein the second sidewall includes an inwardly extending flange directly opposite at least one of the inwardly extending protrusions on the first sidewall.

4. A zipper including:

a first interlocking profile including a first upper rail and a second interlocking profile including a second upper rail; and a slider including a top wall, a first sidewall extending from a first side of the top wall, a second sidewall extending from a second side of the top wall, an opening end wherein the first and second sidewalls are relatively further apart and a closing end wherein the first and second sidewall are relatively closer together; wherein the top wall includes first and second upper channels for engagement by the respective first and second upper rails; wherein the first and second upper channels are separated by a triangular island including one face adjacent to the opening end and one point directed toward the closing end; and wherein the first and second channels are relatively further apart at the opening end and relatively closer together at the closing end; a separator plow descending from the triangular island; a lateral channel formed on the first sidewall; the first profile including a lateral rail for engaging the lateral channel; wherein the first upper channel passes along a first side of the triangular island and the second upper channel passes along a second side of the triangular island; and wherein the first and second upper channels join in the area between the triangular island and the closing end.

5. The zipper of claim 4 wherein the lateral channel is formed between an inverted ledge and inwardly extending protrusions on the first sidewall.

6. The zipper of claim 5 wherein the second sidewall includes an inwardly extending flange directly opposite at least one of the inwardly extending protrusions on the first sidewall.

* * * * *